US007163142B2

(12) United States Patent
DeLine et al.

(10) Patent No.: US 7,163,142 B2
(45) Date of Patent: Jan. 16, 2007

(54) DAMAGE RESISTANT MAILBOX SUPPORT STRUCTURE

(76) Inventors: Randall L. DeLine, 2341 Griner Pkwy., Interlochen, MI (US) 49643; Kerry Luedtke, 6971 Youker Rd., Grawn, MI (US) 49637; James Harris, P.O. Box 252, Honor, MI (US) 49640

( * ) Notice: Subject to any disclaimer, the term of this patent is extended or adjusted under 35 U.S.C. 154(b) by 0 days.

(21) Appl. No.: 11/189,082

(22) Filed: Jul. 25, 2005

(65) Prior Publication Data

US 2006/0255117 A1 Nov. 16, 2006

Related U.S. Application Data

(60) Provisional application No. 60/679,420, filed on May 10, 2005.

(51) Int. Cl.
*A47G 29/12* (2006.01)

(52) U.S. Cl. ..... 232/39; 248/145; 248/417; 248/600

(58) Field of Classification Search ..... 232/39; 248/417, 418, 145, 600, 605, 606; 40/608; D99/32

See application file for complete search history.

(56) References Cited

U.S. PATENT DOCUMENTS 1,273,696 A 7/1918 VanHoöf
1,508,052 A 9/1924 Hastings
2,193,378 A 3/1940 Popp
2,550,338 A 4/1951 Dunagan
2,995,330 A * 8/1961 Alms ..... 248/145
3,407,997 A 10/1968 Wood et al.
3,658,284 A 4/1972 Haaïl
3,861,635 A * 1/1975 Juris ..... 248/284.1
4,737,048 A * 4/1988 Herrstrom ..... 403/229
4,852,847 A * 8/1989 Pagel ..... 248/548
5,207,377 A 5/1993 Brecht
5,215,283 A 6/1993 Gould
5,277,146 A * 1/1994 Hughes, Jr. ..... 116/63 R
5,524,853 A * 6/1996 Varlaro ..... 248/145
5,617,661 A * 4/1997 Mason ..... 40/642.01
5,699,989 A 12/1997 Guthrie
D423,594 S * 4/2000 Green ..... D20/43

* cited by examiner

*Primary Examiner*—William L. Miller
(74) *Attorney, Agent, or Firm*—Douglas S. Bishop

(57) ABSTRACT

A damage resistant mailbox assembly to prevent damage to mailboxes and vehicles, persons or equipment which contact same. The mailbox is supported from an upright support post or structure by one or more expandable and bendable spring units. One end of each spring unit is attached to a plate which is in turn attached to the support post or structure. The other end of each spring unit is attached to the closed end of a standard mailbox enclosure. The device provides for movement of the mailbox when struck by external force, within a 360° radius about an axis substantially parallel to each support spring, with each spring biasing a return to the mailbox structure's original position.

10 Claims, 3 Drawing Sheets

DAMAGE RESISTANT MAILBOX SUPPORT STRUCTURE

This application claims the benefit of Provisional Application No. 60/679,420, filed May 10, 2005.

BACKGROUND OF THE INVENTION

The instant invention, Damage Resistant Mailbox Support Structure, relates, generally, to a device to prevent damage to mailboxes and damage to vehicles, persons, or other equipment which may incidently contact a mailbox, in a standard rural roadside application. The present invention relates more particularly to the mountings and support structures for mailboxes, which, in the instant invention, improve upon the prior art in this field allowing the mailbox to move multidirectionally, and, optimally, in any direction within a 360° radius, about the longitudinal axis of the mailbox structure when the mailbox is struck by a person, a vehicle, road equipment, or any other object.

The concept of providing a pivotable mailbox structure, or a support device for a mailbox, which allows the mailbox to move, in some respect, and with some biasing means, to return the mailbox, after contact, to its initial position, is generally known.

Examples of prior art in this field include U.S. Pat. No. 5,207,377, to Brecht, for a Deflectable Mailbox, which uses a type of "bellows" biasing mechanism to support a mailbox and supporting structure. In the Brecht patent, the bellows structure is mounted on top of a support pole or structure, and attached to the under portion of the mailbox assembly; U.S. Pat. No. 5,215,281, to Gould, is for a Swing-Away Mailbox Support. The Gould patent discloses a mailbox mounted upon a rigid pivoting arm which has a biasing means to return the arm to its original position. Gould provides for potential rotation around the vertical axis of the support structure. The disclosure of the Gould patent, however, suggests less effective performance when the mailbox structure is hit at an upward or downward angle; U.S. Pat. No. 3,658,284, to Hassl, discloses a yieldable support structure. In this example of the prior art, again, the yieldable support is of a type wherein the mailbox is mounted on a rigid and pivoting arm, with a biasing means to return the arm to its original position. Again, the disclosure indicates limited effectiveness to prevent damage from angular blows or vertical blows to the mailbox structure; U.S. Pat. No. 3,407,997, to C. M. Wood et al, for a Rotatable Mailbox, like other examples of the prior art, provides for a mount essentially on top of a support structure and allows for rotational movement of the structure itself about a vertical axis, substantially parallel to the support structure; U.S. Pat. No. 5,699,989, to Guthrie, is a patent for a Mailbox Mounting Device and discloses such a device which returns to its original position after side impact. Like other examples of the prior art, the device disclosed in Guthrie allows rotation, about a vertical axis, atop the support structure pole. Guthrie, as well as other examples of prior art, provides a biasing means, in the way of a spring attachment, to provide a return of the mailbox to its original position. It does not, however, appear to provide the advantages of the present invention against angular strikes. Further, Guthrie, like much of the prior art, does not provide a significant horizontal extension between the front of the mailbox and the support structure, which can be critical for avoiding vehicular contact or contact by road maintenance equipment in rural settings; U.S. Pat. No. 2,550,338, to J. B. Dunnigan, is another example of prior art which discloses a support for mailboxes or the like, again, provides a mailbox mounted on a rigid pivotal arm, which is returned to its original position by biasing means. Again, the primary feature appears to be protection of the mailbox when struck substantially horizontally; U.S. Pat. No. 1,273,696, to L. VanHoof, is for an Automatic Mailbox Hanger, which includes a rigid arm supporting the mailbox. The arm extends horizontally from the support structure, but, like other examples of the prior art cited above, provides for rotation around the vertical axis of the support structure; U.S. Pat. No. 2,193,378, to E. Popp, is another disclosure of a pivotal mailbox, which, again, is mounted on top of the support member for the mailbox, with biasing means to allow rotation, returnable to its original position, about the vertical substantially axis of the support structure.

As can be ascertained by close examination, none of the prior art referenced provides the benefit of the current invention, which is for a full range of directional movement upon impact from various angles, after all of which, the mailbox is returned to its original position automatically and without need for lever arms or other moving parts, or biasing means other than that provided inherently in the body of the support structure itself. In the present invention, the return biasing means concurrently provides a 360° range of motion away from impact about a horizontal axis substantially defined by the length dimension of the mailbox structure itself. The present invention also provides for a mailbox which, when installed, provides that the entire portion of the standard mailbox structure is mounted perpendicular to the support structure, and separately forward thereof.

Further features and limitations of the prior art include, in several instances, a rigid rotatable support member, which support member itself is susceptible of damaging vehicles or equipment contacting the mailbox or the support structure. Other limitations include the need for a separate biasing means, apart from the essential support bracket for the mailbox itself, and, very significantly, most of the prior art, without separate rigid rotatable support members, requires that the mailbox be mounted on the bottom of its enclosure structure, to the top of a support member or pole, thus eliminating any significant separation of the mailbox structure from the support pole and further exposing the support pole or member to additional potential damage from vehicles or road maintenance equipment, persons or the like.

Beyond referenced contact by vehicles and road maintenance equipment, particularly in rural area, vandalism, sometimes euphemistically described as "mailbox baseball," is a severe problem, as well. In such circumstances, vandals may strike the mailbox with rigid objects, from a passing vehicle, or on foot. Often, these blows may be vertically downward, or at least at a substantial downward angle from the horizontal. Accordingly, in order to resist such damage, an appropriate damage resistant mailbox support structure must include a feature to allow the mailbox itself to be moved by contact at angles from above the horizontal, with means to return it to its standard position.

The present invention is directed to, and is an improvement upon, the stated limitations of the prior art. As stated, prior solutions, in the prior art shown, or otherwise, have failed to address the problems solved by the current invention, as they, in general, allow only for lateral/horizontal movement around a vertical axis before returning to an original position. It is necessary for multidirectional movement, in a 360° axis around the horizontal axis of the mailbox structure itself, to be a feature of an optimum mailbox damage prevention support structure, to optimize the reduced damages both to mailboxes and/or contacting vehicles or equipment.

SUMMARY OF THE INVENTION

The present invention has been designed to overcome the short-comings in the prior art noted above.

The invention is directed to provision of a Mailbox Damage Resistant Support Structure which will allow movement of the mailbox when struck in any direction, where normal contact might occur from vehicles, equipment, or persons, in normal movement along the roadway adjacent to which the mailbox is mounted.

The invention provides for support of a mailbox structure on an essentially horizontal axis, perpendicular to a vertical support structure, allowing the entire mailbox structure, and the opening in the front thereof, to extend roadward, away from the support structure, thus minimizing potential damage to the support structure, as an added benefit. The device is also constructed to allow it to move vertically or horizontally, or in some combination thereof, about the horizontal longitudinal axis of the mailbox structure itself, when struck from the top, bottom or side, or any angle in between.

The present invention combines support for the mailbox structure itself, extending from the mounting post, with the feature of a contained inherent biasing means also comprising the support member, eliminating significant weight and mass which would otherwise be added to the mailbox and structure. This also allows for the mailbox to be moved upon impact with less force, which, accordingly, results in less or no damage to the mailbox, or to vehicles, equipment or persons contacting it, when struck with like force.

The invention, further, is also resistant to vandalism, which is a frequent problem in rural areas, because of its multidirectional movement function and ability to absorb a blow directly downward or angularly downward.

The current invention relies upon the combination of a standard mailbox structure which has a first, openable end, usually with a hinge-mounted door, and a second, rearward end, which is normally a vertical surface, and permanently closed. One or more extension spring support members are attached at one end, to the closed end of the mailbox, and extend in a manner so that they substantially extend along the same axis as the horizontal axis of the standard mailbox. At their other end, each of these spring support structures is attached to a mounting plate. The mounting plate is then attached to the mailbox support pole or other support structure at a position to hold the mailbox at the desired height above the ground, and to allow an area of free space beneath the mailbox structure itself.

The present invention is susceptible of manufacture, sale and installation as a complete unit, including the mailbox structure itself, or, may be manufactured, sold and distributed in limited form, for attachment to any standard mailbox structure, by providing instructions and fastening devices to attach the forward end of the one or more extension spring support members to the vertical closed end of an existing mailbox structure.

In either case, the mailbox structure is mounted to the support member or pole in the same general manner. The manner of mounting may include a flat plate which is bolted, welded, or otherwise affixed to the rearward vertical surface of the support structure; a unit attached to the spring support members which covers the outside surface of the structure, with a means for holding it in place, or, a type of element, which overlaps, or covers, the top of the support pole or structure.

The above and additional features of the invention may be considered and will become apparent in conjunction with the drawings, in particular, and the detailed description which follows.

BRIEF DESCRIPTION OF THE DRAWINGS

The following detailed description is understood by reference to the following drawings.

DETAILED DESCRIPTION OF THE PREFERRED EMBODIMENT

Figure 1:
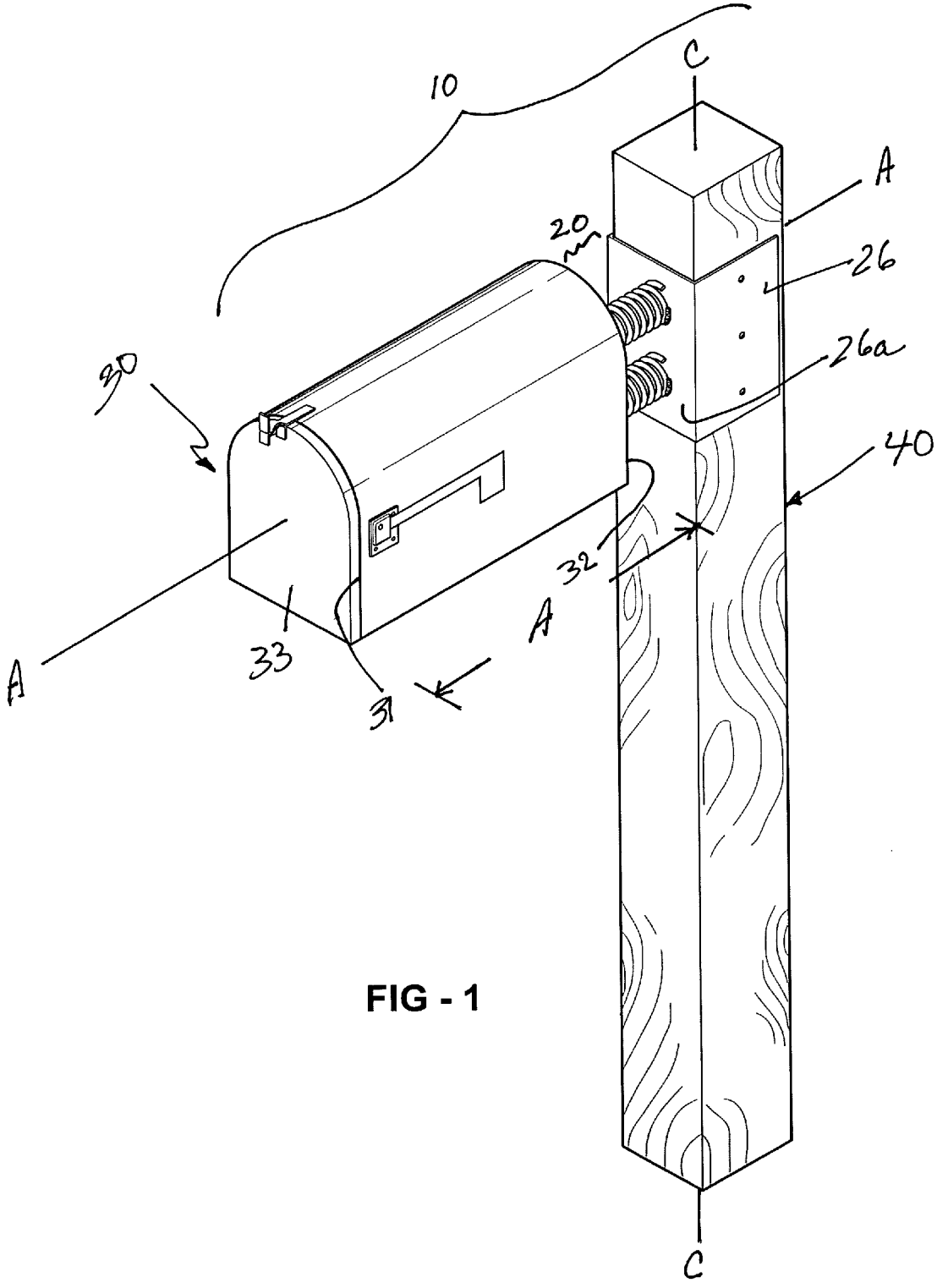
FIG. 1 is a perspective view of the invention, showing a substantially vertical support post, with a standard mailbox structure, and a pair of spring support members, on an axis approximately perpendicular thereto.

Throughout the following detailed description, like numerals are used to describe the same element of the present invention and the multiple figures thereof.

The invention, Damage Resistant Mailbox Support Structure, is a damage resistant mailbox support structure which allows movement of a standard mailbox enclosure, when struck by an outside force, both horizontally and vertically, and in combinations thereof, about the longitudinal, substantially horizontal axis of the mailbox structure, as normally mounted.

Broadly considered, the invention 10 consists of a support structure assembly 20 supporting a standard mailbox enclosure 30 from a supporting pole or structure 40.

The mailbox enclosure 30 is of standard construction in the industry and further has forward openable end 31 and a rearward closed end 32. End 31 is openable by means of a hinged door 33.

In standard installation, enclosure 30 is installed along a substantially horizontal axis A—A, along its length dimension A. Closed end 32 is substantially planar and vertical, and perpendicular to axis A—A.

The support structure assembly 20 has a pair of coiled extension springs 21. These springs 21 are mounted vertically in tandem, horizontally parallel along their defined uniform length B. Each spring 21 has a first forward end 21*a* and a second rearward end 21*b*. In practice, a single spring may be utilized or multiple additional springs may be used in place of the pair of springs 21. Whether there is one or more springs 21, each has first end 21*a* and second end 21*b* and defined length B. Springs 21 are mounted in assembly 20, with their respective lengths B substantially in parallel with axis A—A. Each of springs 21 is fully compressed in it no-load position. Springs 21 are used to provide biasing or return force to return structure assembly 20 at enclosure 30 to their original or no-load position.

Figure 2:
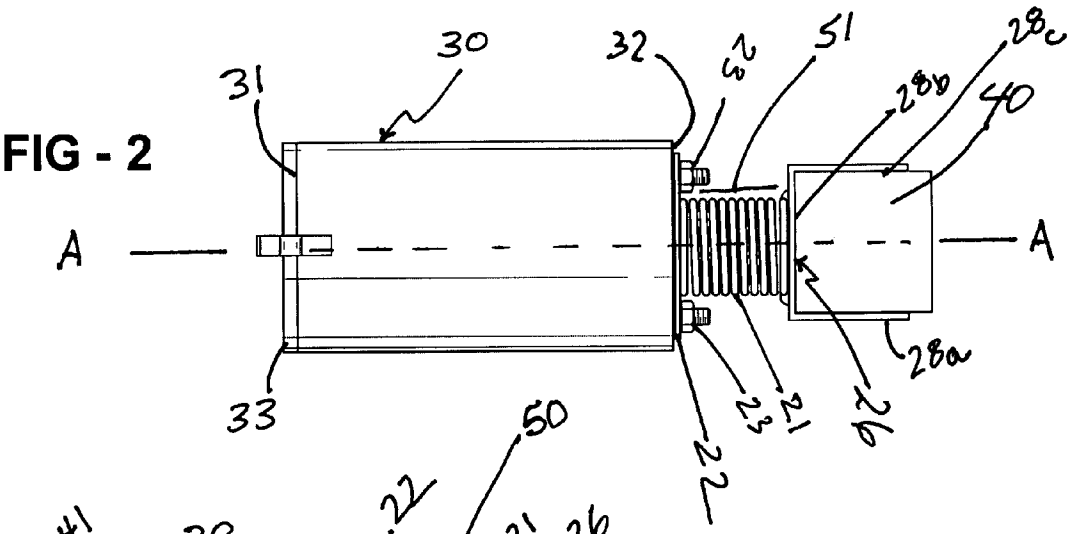
FIG. 2 is a top view of the invention showing the primary components of the invention, including a standard mailbox structure, spring support member, mounting bracket, and vertical support pole.
Figure 3:
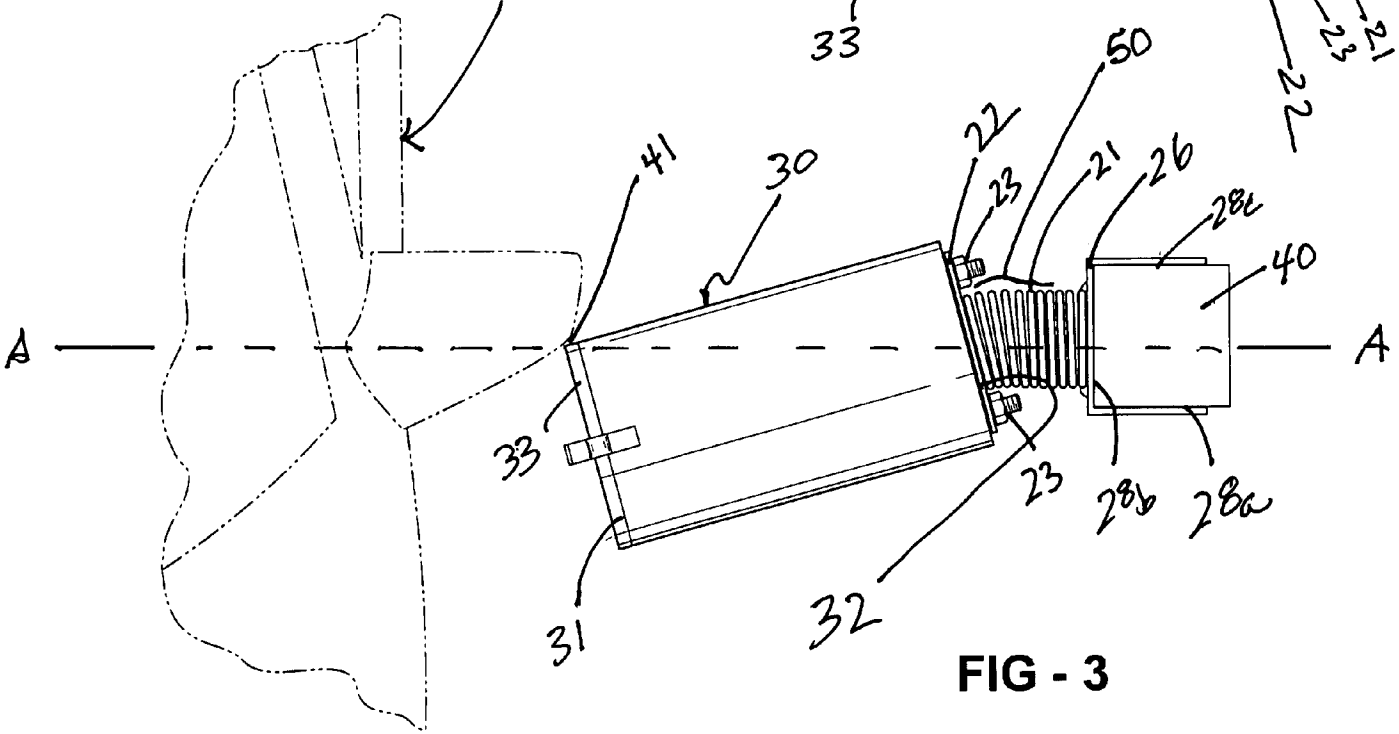
FIG. 3 is a top view of the invention showing resistant movement of the mailbox structure, when struck by a portion of a vehicle shown in outline.
Figure 4:
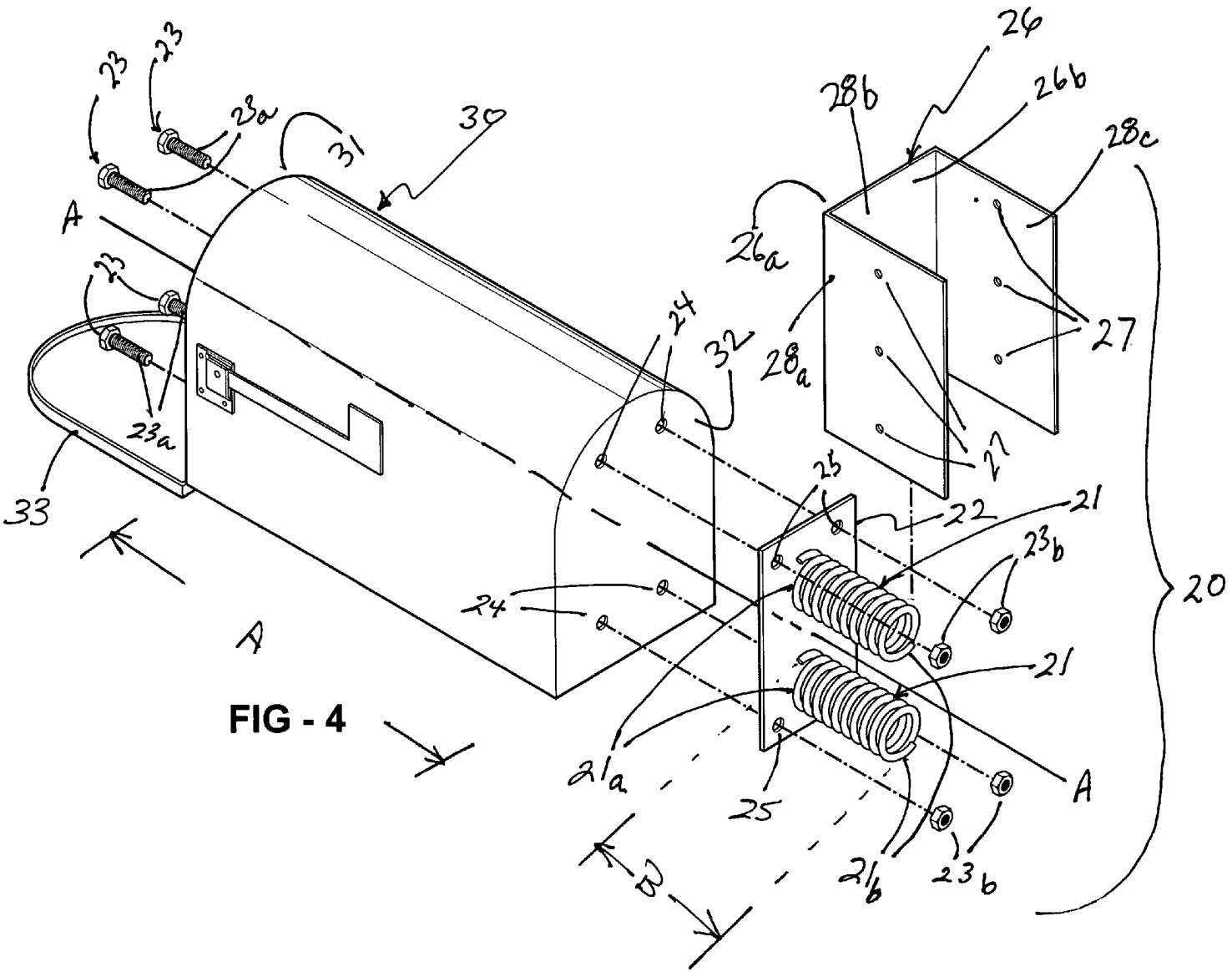
FIG. 4 is an exploded view of the invention showing the standard mailbox structure, attaching structure, two vertical support springs, and a member for attaching the same to a support post.

Springs 21, at first ends 21*a* are affixed to a forward mounting plate 22. Mounting plate 22 is preferably planar and configuring to fit conformably against closed end 32. In practice, closed end 32 and mounting plate 32 may be the same, so that first end 21*a* of each spring 21 is affixed directly to closed end 32. Alternatively, mounting plate 22 may be attached or affixed to closed end 32 by one or more fasteners 23. Fasteners 23 are shown in FIGS. 2, 3 and 4 as bolt 23*a* and nut 23*b* combinations, fastened through apertures 24 in closed end 32 and conforming corresponding apertures in mounting plate 22. In practice, alternative fasteners 23 may be rivets, metal screws, welds or other equivalents.

Springs 21 are further connected at their second ends 21*b* to a rear mounting member 26 on its forward side 26*a*. Rear side 26*b* of rear mounting member 26 fits conformably against and is mounted upon supporting pole or structure 40.

As shown in FIGS. 1 and 4, rear mounting member 26 may be affixed to structure 40 by fasteners driven through apertures 27. Such fasteners may be nails, screws, bolts or other equivalent means. Likewise, the affixation of member 26 to structure 40 may be accomplished by adhesive devices or by otherwise conforming member 26 to fit upon structure 40. In FIGS. 1, 2, 3 and 4 rear mounting member 26 is shown as three planar surfaces 28*a*, 28*b* and 28*c* conformed to the outer surfaces of structure 40.

As is clear from the above description and drawings, springs 21 are the horizontal support for mailbox structure 30 and the biasing means to return the structure 30 to its static position after any impact. Springs 21, as stated, are coiled extension springs, under tension. Impact 41 by external force 42 upon the mailbox structure 30, as shown in FIG. 3, causes a reactive expansion 50 of the spring 21 and allows the mailbox structure 30 to move away from the point of impact 41. Following impact, the biasing nature of the extension spring 21 causes it to return to its normal static position as shown in FIG. 2 with the spring 21 and mailbox structure 30 aligned along horizontal axis A—A perpendicular to the vertical axis C—C of structure 40.

The support structure 20 and the springs 21 comprising it must be able to horizontally support mailbox enclosure 30 including anticipated contacts in static position along axis A—A. In normal instances, springs 21 have a spring rate sufficient to support weight at their first end 21*a* in a range of zero to twenty pounds. However, special circumstances may require springs 21 to have spring rates sufficient to support weights of twenty to fifty pounds, or greater, at first end 21*a*.

The no-load length of springs 21 may also vary within a preferred range of one to eighteen inches for normal applications, with the option under special circumstances to provide springs 21 in no-load lengths of eighteen to thirty-six inches. In the event that it may be desirable to provide that enclosure 30 is suspended at a greater distance from structure 40, without lengthening springs 21, rear mounting member 40 may be configured to provide a horizontal extension dimension as well.

It is the claims appended hereto, and all reasonable equivalents thereof, which define the true scope of the invention, and the invention is not limited to the depicted embodiments and exemplifications.

What is claimed is:

1. A damage resistant mailbox support structure, comprising:

a horizontal mailbox enclosure member having a openable end and closed end;

a tensioned biasing support member having a first end and second end and a defined length;

a rear mounting member;

wherein the first end of the tensioned biasing support member is directly affixed to the closed end of the mailbox enclosure member, and the second end of the tensioned biasing support member is affixed to the rear mounting member; and the horizontal axis of the mailbox enclosure member and the defined length axis of the tensioned biasing member are substantially parallel.

2. The structure of claim 1, wherein the tensioned biasing support member comprises a coiled extension spring.

3. The structure of claim 1, wherein the tensioned biasing support member comprises a plurality of parallel coiled extension springs.

4. The structure of claim 1, wherein the tensioned biasing member comprises a pair of coiled extension springs mounted horizontally in vertical parallel, along their respective defined lengths.

5. The structure of claim 1, wherein said tensioned biasing support member is sufficient to horizontally support a suspended weight of zero to twenty pounds at its first end.

6. The structure of claim 1, wherein said tensioned biasing support member is sufficient to horizontally support a weight of twenty to fifty pounds at its first end.

7. The structure of claim 1, wherein the defined length of the tensioned biasing support member is one to eighteen inches.

8. The structure of claim 1, wherein the defined length of the tensioned biasing support member is eighteen to thirty-six inches.

9. A damage resistant mailbox support structure, comprising: a horizontal mailbox enclosure member having a openable and closed end; a tensioned biasing support member having a first end and a second end and a defined length; a rear mounting member; wherein the first end of the tensioned biasing support member is affixed to the closed end of the enclosure member by a forward mounting member, said biasing support member is directly affixed to the forward mounting member and the forward mounting member is directly attached to the closed end of the mailbox enclosure structure by one or more fasteners, and the second end of the tensioned biasing support member is affixed to the rear mounting member; and the horizontal axis of the mailbox enclosure member and the defined length axis of the tensioned biasing member are substantially parallel.

10. The structure of claim 9, wherein each fastener comprises a bolt and nut assembly.

* * * * *